US005282573A

United States Patent [19]

Reimer

[11] Patent Number: 5,282,573

[45] Date of Patent: Feb. 1, 1994

[54] SPRAY COATING SYSTEM AND METHOD

[75] Inventor: James H. Reimer, Alvin, Tex.

[73] Assignee: Plastic Flamecoat Systems, Inc., League City, Tex.

[21] Appl. No.: 760,866

[22] Filed: Sep. 16, 1991

[51] Int. Cl.[5] ..... B05B 1/24

[52] U.S. Cl. ..... 239/85; 239/13; 239/79; 239/424; 239/428; 137/891; 137/893; 406/128

[58] Field of Search ..... 239/79, 85, 13, 424, 239/428, 422; 251/58; 137/891, 893; 406/128

[56] References Cited

U.S. PATENT DOCUMENTS

| | | | |
|---|---|---|---|
| 3,129,889 | 4/1964 | Cape | 239/79 |
| 3,333,774 | 8/1967 | Demaison | 239/85 |
| 3,442,454 | 5/1969 | Stenger et al. | 239/85 |
| 4,231,518 | 11/1980 | Zverev et al. | 239/85 |
| 4,262,848 | 4/1981 | Chabria | 239/112 |
| 4,290,555 | 9/1981 | Suwa et al. | 239/85 |
| 4,632,309 | 12/1986 | Reimer | 239/8 |
| 4,647,003 | 3/1987 | Hilpert et al. | 251/58 |
| 4,728,033 | 3/1988 | Matsumura et al. | 239/112 |
| 4,934,595 | 6/1990 | Reimer | 239/85 |
| 5,071,289 | 12/1991 | Spivak | 406/128 |

FOREIGN PATENT DOCUMENTS

| | | | |
|---|---|---|---|
| 304719 | 2/1917 | Fed. Rep. of Germany | 406/128 |
| 3640906 | 6/1988 | Fed. Rep. of Germany | 239/85 |
| 1162502 | 6/1985 | U.S.S.R. | 239/79 |
| 1212609 | 2/1986 | U.S.S.R. | 239/85 |
| 812601 | 4/1959 | United Kingdom | 239/85 |
| 1140511 | 1/1969 | United Kingdom | 239/85 |

*Primary Examiner*—Andres Kashnikow
*Assistant Examiner*—Christopher G. Trainor
*Attorney, Agent, or Firm*—Ross, Howison, Clapp & Korn

[57] ABSTRACT

A flame spray coating system includes a thermoplastic resin powder supply hopper, an eductor adapted to entrain powder in a stream of conveying air, a valve disposed between the powder hopper and eductor for controlling the flow of powder from the hopper into the eductor, a flame spray gun and conduits interconnected between the flame spray gun and pressurized air and combustion gas sources for delivering flows of propelling air, conveying air, powder entrained in conveying air, and a combustible gas to the flame spray gun, and an eductor control disposed on the flame spray gun for controlling operation of the valve disposed between the powder hopper and eductor. A solid circular coating pattern is created with a nozzle constructed for twirling the entrained powder and conveying air. Interchangeable combustion nozzles of different sizes allow the same spray gun to be used for different substrate conditions.

12 Claims, 4 Drawing Sheets

SPRAY COATING SYSTEM AND METHOD

BACKGROUND OF THE INVENTION

1. Technical Field

This invention relates to a system and method for supplying and melting a particulate material comprising a powdered thermoplastic resin and for propelling the melted material onto the surface of a substrate to provide the substrate with a coating having desired physical properties and characteristics. More particularly, this invention relates to a flame spray coating system comprising a flame spray gun and means for supplying powdered particulate material, an oxidizing gas and a combustible gas to the gun; and a method for using the flame spray gun and the supply means to coat a substrate.

2. Prior Art

Methods and apparatus for flame spraying thermoplastic resins onto substrates are previously known, having been disclosed for example in U.S. Pat. Nos. 4,632,309 and 4,934,595.

In a spray gun of the type disclosed in U.S. Pat. No. 632,309, an open-atmosphere powdered flame spray gun and a method are disclosed in which a powderized thermoplastic material, combustion air and a combustion gas are delivered through a plurality of passageways extending through the spray gun body into an open mixing and combustion chamber defined by a cylindrical hood extending beyond the spray gun body. The resultant mixture is ignited and the thermoplastic material is melted in the flame combustion area while entrained in a stream of pressurized air that propels the melted material onto the substrate.

One limitation experienced through use of the method and apparatus disclosed in U.S. 4,632,309 was that projecting the stream of combustible gas into the combustion chamber at an oblique angle toward the axis of the combustion chamber and toward the central stream of propelling air and entrained particulate material actually caused a "pinching" of the stream of particulate material and limited the quantity of thermoplastic material that could be melted and delivered for spray coating. In addition, the angular delivery of the combustible gas in the combustion chamber was found to limit the size of the flame "tunnel" emanating from the combustion chamber, and therefore was a self-limiting factor in the total quantity of particulate thermoplastic material that could be melted for spray application. Further, if increased flow rates of particulate material were desired to be delivered by the spray gun, an improved hopper and eductor feed means were necessary to entrain and mix the desired quantity of particulate material in the stream of propelling air.

U.S. Pat. No. 4,934,595 disclosed a flame spray coating system comprising an improved flame spray gun, eductor mechanism and means for controlling the flow of the powdered thermoplastic material. One modification to the flame spray gun of U.S. Pat. No. 4,934,595 over the gun disclosed in U.S. Pat. No. 4,632,309 was the addition of a flexible diaphragm between the body member of the gun and the flame hood assembly. The purpose of the diaphragm was to function as a seal between the body member and flame hood assembly, and to better balance the flow of combustible gas (preferably propane) around the annulus supplying the combustible gas to the combustion chamber. Another modification was redirection of the longitudinal axes of the outermost array of circumferentially spaced combustion gas orifices so as to be parallel to the axis of the hood section and thereby alleviate "pinching" of the annular flow of propelling air and the circular stream of particulate material and conveying air emerging from the gun. Another modification was the provision of sections at the outlet ends of the flow nozzle and flow nozzle bore to promote radial expansion of the streams of conveying air (containing entrained powdered thermoplastic material) and propelling air, respectively, as they emerged from the gun.

The flame spray coating system disclosed in U.S. Pat. No. 4,934,595 was also adapted to control the flow of powder through the gun by means of a valve disposed in the gun handle that was manually operated to block the flow of conveying air and powder at the gun whenever the operator needed to stop coating. Such needs can frequently arise during a coating operation, for example, Whenever the operator reaches a discontinuity in the surface being coated, needs to change position, take a break, or the like.

Although the devices previously disclosed have proved to be effective for applying protective polymeric coatings to many different kinds of substrates, including for example, bridges, ship hulls, plant piping, and the like, disadvantages have been experienced that can limit their effectiveness under some conditions of use. One disadvantage encountered through use of the flame spray coating system disclosed in U.S. 4,934,595 is that blocking the flow of conveying air and entrained powder at the gun traps conveying air and entrained powder in the flow line from the eductor to the gun, permitting the powder to settle out. Whenever the flow is reestablished by opening the valve, the powder that settled in the flow line can be discharged from the gun in large "blobs" that are undesirable for evenly coating a substrate, or can collect inside fittings, chambers or orifices in the gun to impede flow and necessitate frequent disassembly and maintenance.

Another disadvantage encountered through use of the flame spray coating systems disclosed in the prior art is that different sized guns are required in order to achieve the different coverage areas and coating rates needed for various coating jobs. For example, a two inch diameter gun might be desirable for coating small diameter piping or other substrates having relatively small surfaces, whereas a four inch diameter gun might be desirable for coating larger surface areas on the same job. With the prior art devices, two separate guns would be required, with the necessity of completely shutting down the system to disconnect all flow lines from one gun and reconnect them to another. This would entail disconnecting and reconnecting the conveying air and powder supply line, the propelling air supply line and the combustible gas supply line.

A third disadvantage encountered through use of the prior art flame spray coating systems is that most of the thermoplastic powder is deposited on the surface of the substrate in a circular pattern in which the interior of the circle is substantially void. While improvements to the flame spray gun (flaring the diameter of the central bore and the inside diameter of the powder flow nozzle in the section adjacent to the outwardly facing plate surface of the flame hood assembly) disclosed in U.S. Pat. No. 4,934,595 aided in expanding the diameter of the powder pattern deposited on a substrate from a given distance, a flame spray gun is needed can that apply powder in an expanded, filled circular pattern.

SUMMARY OF THE INVENTION

According to the present invention, a flame spray coating system is provided that comprises means for controlling the flow of thermoplastic powder from a powder source to a flame spray gun independently of the flow of conveying air utilized to transport the powder through the gun. According to a preferred embodiment of the invention, the system comprises a powder hopper; an eductor means adapted to entrain powder in a stream of conveying air; a pneumatically operated valve disposed between the powder hopper and eductor for controlling the flow of powder from the hopper into the eductor; a flame spray gun; means for delivering flows of propelling air, conveying air, powder entrained in conveying air, and a combustible gas to the flame spray gun; and means disposed on the flame spray gun for controlling operation of the valve disposed between the powder hopper and eductor, and for controlling the flow of combustible gas to the gun.

According to another embodiment of the invention, a feed assembly is provided for use in a flame spray coating system that comprises a powder source, a pressurized gas source, means for regulating a stream of gas from the pressurized gas source, means for introducing powder into the stream of gas from the pressurized gas source, and pneumatically actuated means for selectively controlling the introduction of powder into the stream of gas from the pressurized gas source.

According to another embodiment of the invention, a powder flame spray gun is provided that comprises means for connecting the gun to a source of pressurized conveying gas and means disposed on the gun for controlling the introduction of a thermoplastic powder into the pressurized gas at a point remote from the gun.

According to another embodiment of the invention, a powder flame spray gun is provided that comprises releasably engageable body and hood sections, the body section comprising means for connecting lines delivering pressurized gas, thermoplastic powder and a combustible gas to the gun, the body of the gun being further adapted for alternate engagement with hood sections of differing diameters to achieve different coverage areas and coverage rates for spray coating.

According to another embodiment of the invention, a powder flame spray gun is provided that comprises a flow nozzle providing communication between a source of pressurized gas containing entrained thermoplastic powder and a flame hood assembly, the flow nozzle further comprising a longitudinally spiraling insert adapted to bifurcate the flow of gas and powder through a portion of the nozzle, the flow nozzle being adapted to recombine the flow of gas and powder prior to discharging the recombined flow into the flame hood assembly.

According to another embodiment of the invention, a method is provided for flame spraying a thermoplastic coating onto a substrate comprising the steps of: providing a source of powder comprising a major portion of a thermoplastic resin; providing a flame spray gun; providing a stream of pressurized gas to convey the powder from the powder source to the flame spray gun; providing means at the flame spray gun for controlling the introduction of powder into the stream of pressurized gas at a point remote from the flame spray gun; providing propelling gas and combustible gas to the flame spray gun; combusting the combustible gas to melt the powder as it is discharged from the flame spray gun; and applying the melted powder to a substrate. According to a particularly preferred embodiment of the invention, the melted powder is applied to a substrate in a filled circular pattern.

BRIEF DESCRIPTION OF THE DRAWINGS

The system and method of the invention are further described and explained in relation to the following FIGURES of the drawings wherein.

DESCRIPTION OF THE PREFERRED EMBODIMENTS

Figure 1:
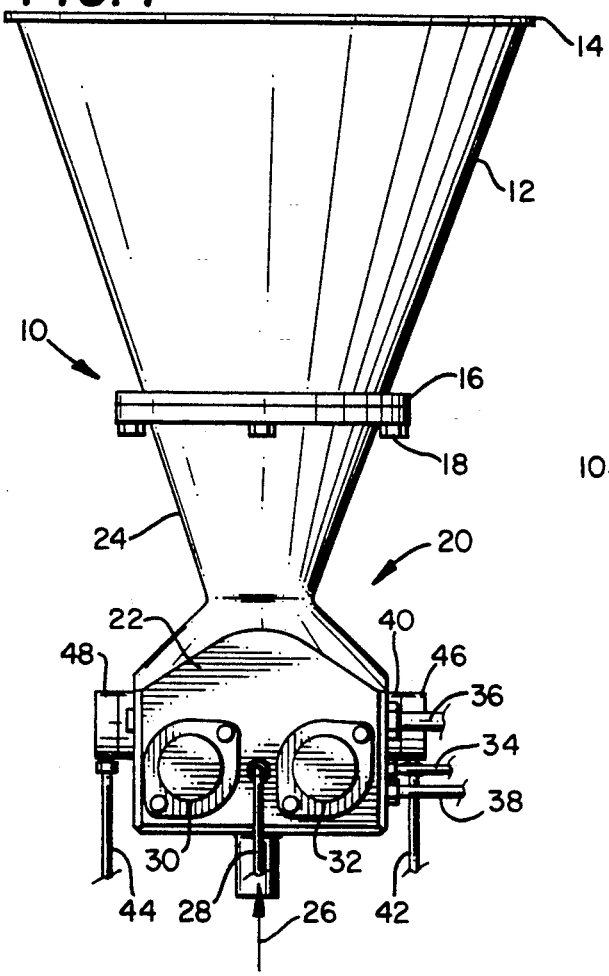
FIG. 1 is a front elevation view of the powder source and feed assembly of the system of the invention.

FIG. 1 depicts a powder source and feed assembly 10 in a front elevation view according to the present invention. Gravity fed powder hopper 12 having a lid 14 is connected at flange 16 with connection means 18 to an eductor assembly 20. The eductor assembly 20 includes a body 22 and an input powder neck portion 24. Pressurized air, schematically represented by arrow 26, is input through conduit 28 which conduit 28 communicatingly interconnects and feeds air pressure 26 to eductor air flow regulator 30, and to propelling air flow regulator 32. The portion of air 26 which is not used or not flowing through regulators 30 and 32 connects to control air supply conduit 34 which communicates with eductor control switch 50. The powder source feed assembly 10 is further operatively associated with the flame spray gun 70 as will be explained in further detail below with reference also to FIGS. 2 and 3.

The output of the eductor air flow from regulator 30 travels past eductor control valve assembly 40, through eductor assembly 20, and from eductor assembly 20 to the flame spray gun 70 through eductor carrier air output conduit 36. The adjustably regulated air from propelling air flow regulator 32 is provided at a desired regulated pressure through regulated air conduit 38 to the flame spray gun 70. The compressed air 26 communicates with control switch 50 through conduit 34. Switch 50 selectably routes the control air pressure back to eductor control valve assembly 40 through either conduit 42 or conduit 44 to actively pressurize either control chamber 46 or control chamber 48 to open or close valve 60 in order to control the flow of powdered plastic material 11 from hopper 12 into the carrier air which flows to spray gun 70 with or without the powder.

Figure 2:
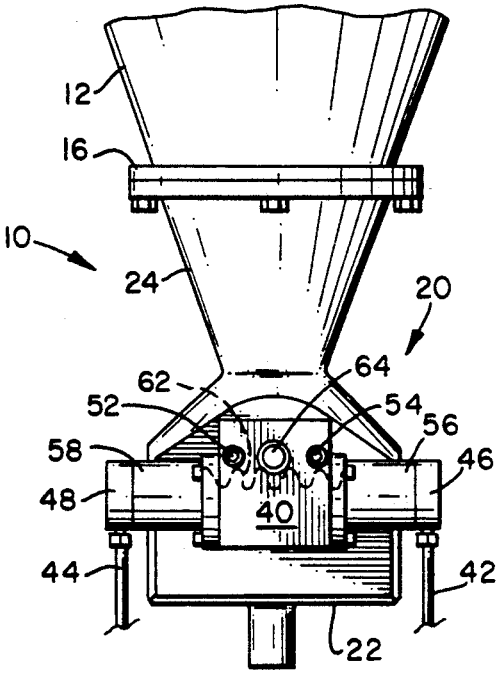
FIG. 2 is a rear elevation view, partially broken away, of the powder source and feed assembly of FIG. 1.

FIG. 2 shows a partial rear elevation view of the powder source and feed assembly 10 in which the attachment of the eductor control valve assembly 40 can be better understood. To the back of eductor body 22 the valve control assembly 40 is attached with attachment means 52 and 54 which sealingly hold the valve assembly 40 to the eductor body 22. The pressure chambers 46 and 48 are shown opposite piston chambers 58 and 56 and which in the preferred embodiment actuate a rack and rack mechanism 62 back and forth which in turn rotates an operatively engaged pinion mechanism 64 as will be further explained with respect to FIGS. 4 and 5 which shows one preferred embodiment of the mechanism by which powder 60 is introduced from hopper 12 into the eductor passage 36.

Figure 3:
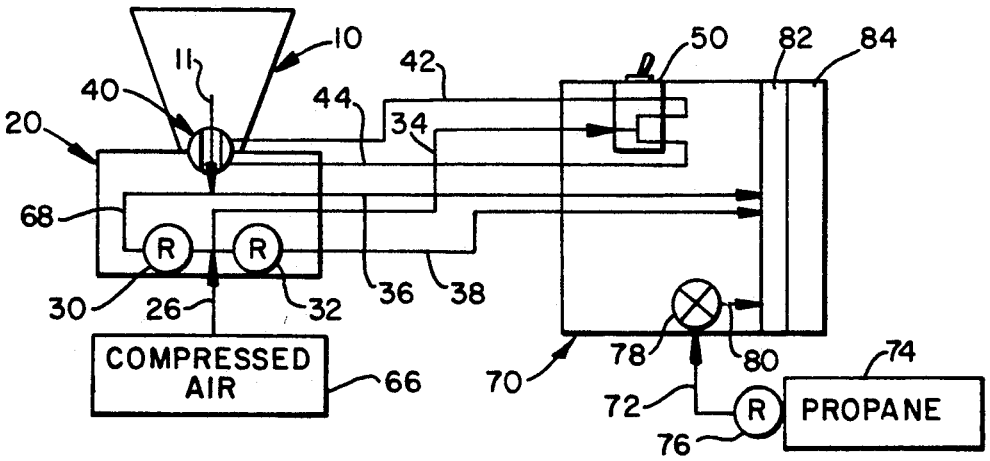
FIG. 3 is a simplified schematic diagram depicting the system of the invention.

FIG. 3 shows a simplified schematic of the system and method of supplying and melting a particulate material comprising a powdered thermoplastic resin and for propelling the melted material onto the surface of a substrate to provide a coating having desired physical properties and characteristics. As discussed previously, the various components of the system include a powder source and feed assembly 10 attached through an eductor assembly 20 which is supplied with compressed air 26 from a compressed air source 66 to regulator valves 30 and 32. The eductor air pressure regulator valve 30 provides pressurized carrier air through a conduit portion 68 and past an eductor valve within valve control assembly 40. The carrier air flow picks up and entrains powdered material 11 from hopper 10 and carries it along through conduit portion 36 to an open atmosphere powdered flame spray gun 70. The unregulated control air pressure communicates through control air conduit 34 with a control switch 50 which in the preferred embodiment is an air toggle switch 50 or an AB type fluid switch so that pressure in conduit 34 flows through either conduit 42 to the valve control assembly 40 when in one position or flows through conduit 44 to control valve assembly 40 when in a second position. The toggle switch 50 is mounted on the flame spray gun itself for convenient operation of the valve control assembly 40 by the operator of the gun even though the powder source and feed assembly may be at a remote location. For example, in a production unit the powder source and feed assembly may be at a fixed location on the plant floor with flexible conduits extending to the flame spray gun 70. Alternatively, in a portable on site embodiment the powder source and feed assembly including the powder control valve 40 may be strapped to the back of the operator while the spray gun is held in the hands of the operator for on site flame coating. It will be noted that the compressed air flow 26 which is utilized through regulator 32 continues on through propelling air conduit 38 into the flame spray gun 70 at the appropriate regulated pressure for accomplishing complete melting of the propelled powder. Higher pressure for low melting temperature materials shortens the time in the flame. Lower propelling pressure increases the effective melting time for higher melting temperature materials. The flame spray gun is also supplied with combustible gas 72 which is preferably a propane gas from a pressurized source 74 regulated with propane regulator 76. The flow of the combustion gas can be initiated and adjusted by the operator with a flow valve 78. In this manner the various flows including the carrier air and powdered plastic flow 36, the propelling air flow 38 and the combustible gas or propane flow 80 are operatively combined in various portions of the spray gun 70 schematically represented in FIG. 3 as a mixing area 82 and a flame hood area 84. The specific spray gun 70 operation will be more fully understood with reference below to FIGS. 6–9 of the preferred embodiments.

The details of the operation of the powdered source and feed assembly will be understood more fully in detail with respect to FIGS. 4 and 5 below. Many of the advantages can however be understood with reference to the description above and in particular to the schematic drawing of FIG. 3, it being noted that the input of plastic material into carrier conduit 36 through valve assembly 40 is controlled by the operator of the gun with switch 50 from the spray gun at a remote location. When the valve assembly 40 is in a closed hopper position, no powder is entrained in the regulated flow 68 and the carrier gas flow conduit 36. However, the regulated air flow 68 from regulator 30 will continue uninterrupted even when the control switch 50 is activated to close the valve 60 in assembly 40. This allows for clean termination of the operation of the flame spray gun 70 by the operator while avoiding the disadvantage of filling the carrier gas conduit 36 with powder which would be the result if the flow of air in carrier gas conduit 36 was terminated after the powder was entrained. Thus by controlling the input of plastic powder into the carrier air, the flame spray process and operation is made smoother. The spray can be stopped and started when arriving at discontinuities or interrupted surface substrate conditions without terminating the heat generated by the spray gun. This will approximate a steady state burning condition as the proportion of air and fuel mixture is maintained even though the plastic to be melted is terminated. Further, undesirable conditions such as blobbing of plastic at startup are avoided. Also the amount of cleaning and maintenance is reduced when the introduction or the eduction of powdered material is again started.

Figure 5:
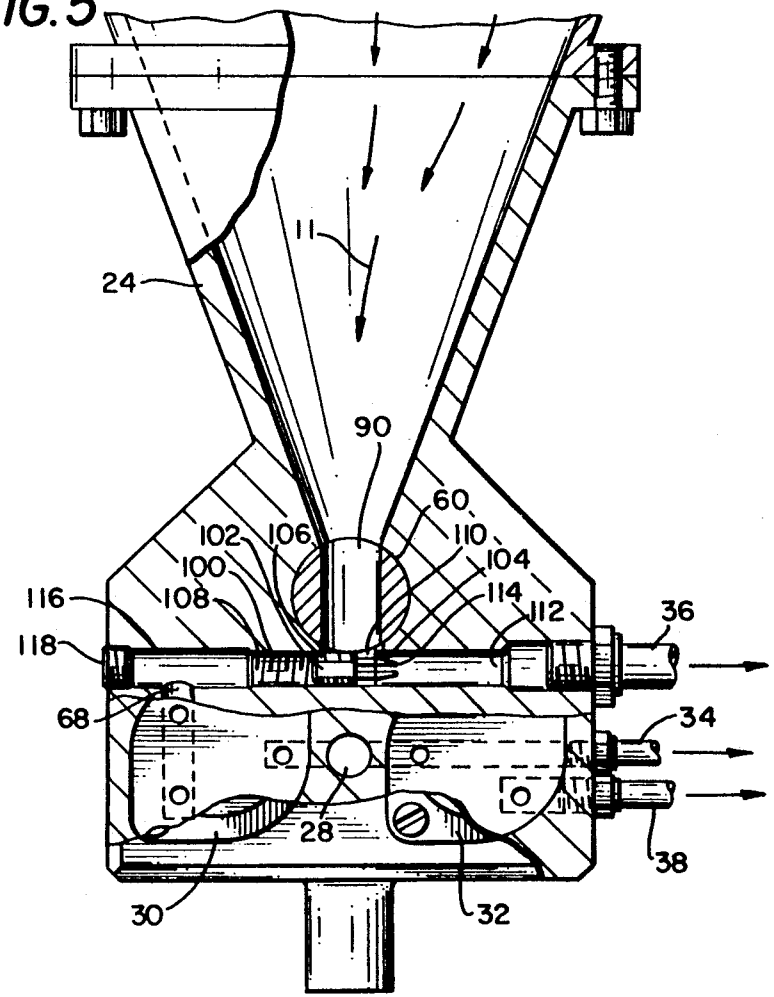
FIG. 5 is enlarged front elevation view, partially broken away and partially in section, of the powder source and feed assembly of the invention.
Figure 4:
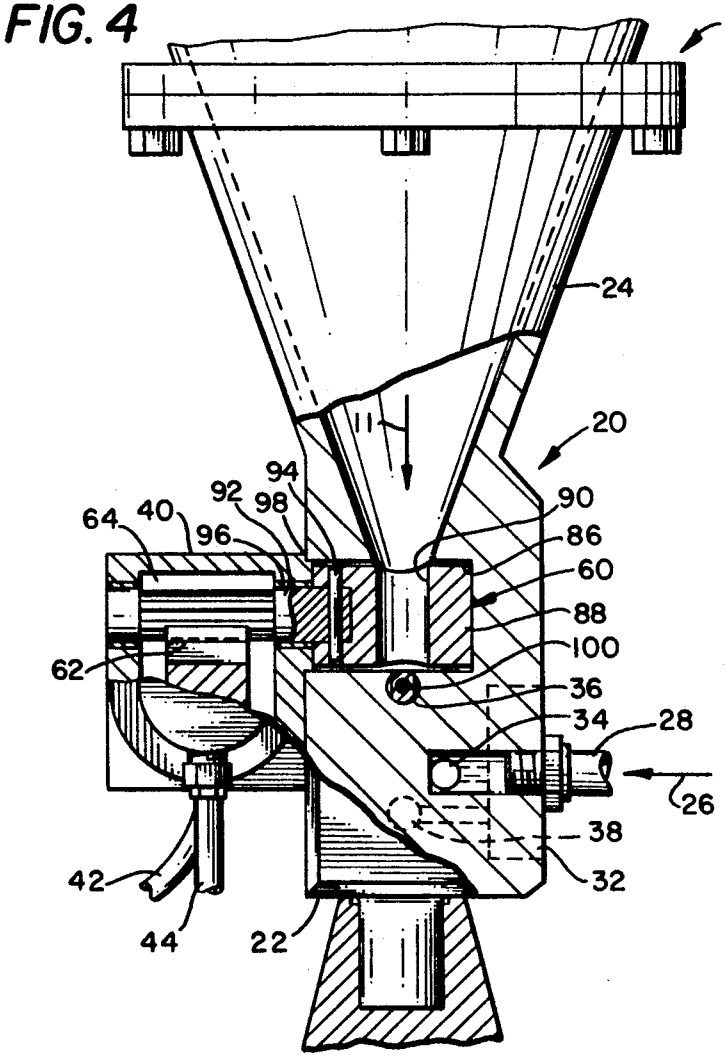
FIG. 4 is an enlarged side elevation view, partially broken away and partially in section, of the powder source and feed assembly of the invention.

FIGS. 4 and 5 show an enlarged side elevation view and an enlarged front elevation view, respectively, with partially broken away and partially in section portions, of the powder source and feed assembly of the invention. A barrel valve assembly 60 is formed in control valve assembly 40. There is a valve bore 86 and a rotational valve portion 88 having a valve opening or orifice 90 drilled there through such that rotation by 90° from the position shown in FIGS. 4 and 5 will move opening orifice 90° from a vertical position to a horizontal position thereby closing passage of powder 11 from the hopper 12. The rotation is accomplished with the rack 62 and the rotary pinion 64 which are activated as discussed previously by pressurizing either conduit 42 or conduit 44, thereby moving the rack back and forth relative to pinion 64 to cause rotation of rotary shaft 92 which is pinned at 94 to rotary valve portion 88. The control valve assembly 40 is sealingly connected at 98 to the back of eductor assembly body 22. When the valve 60 and orifice 90 are in the open feed position as shown in FIGS. 4 and 5, air pressure 26 passes through regulator 30. The regulator air flow from regulator 30 passes through transfer conduit 68 and out through carrier air passage 36. Powder 11 flows down into the eductor nozzle 100 which acts to cause the powder plastic resin to be entrained in the air flow through carrier air passage 36. When barrel valve 60 is rotated 90°, valve opening 90 is rotated 90° from a vertical open position to a horizontal closed position and the powder flow is terminated. The flow of carrier air in conduit 36 continues as only the regulated air without any plastic powder being added thereto.

An eductor nozzle 100 which has an elongated cylindrical body portion 102 and a conically-tapering nozzle tip 104 is removably inserted in a first passageway 106. The outer wall surface of at least a portion of the nozzle body 102 carries threads 108 that mate with a threaded portion (not shown for simplicity) of the first passageway 106. The threaded connection between the nozzle body 102 and the walls of the first bore passageway 106 permit the nozzle tip 104 to be horizontally adjustable with respect to the chamber 110 and the second passageway 112. The nozzle body 102 is horizontally adjusted within the bore 106 to position the conically-tapering nozzle end 104 within the chamber 110 to permit the nozzle tip 114 to project into the bore 112 but leaving sufficient annual clearance between the tapering end 104 of the nozzle 100 and the bore 112 for permitting free flow of particulate thermoplastic material from the hopper, receiver 24 and chamber 11? into the second passageway 112 where it is carried through conduit 36 to the spray gun.

One end of carrier air passage 106 may be sealingly plugged at 118 opposite conduit 36 to allow insertion of the eductor valve 100 and otherwise to assist in the manufacture of the eductor valve passageways. In this manner and with the convenience of the use of the same pressurized air source for the controlling switch 50, valve 40, and valve mechanism 40 and the eductor valve 100, the entire assembly can be constructed inexpensively and for durable long life operation with minimized maintenance. When and if maintenance is required, the assembly is constructed for easy access disassembly and repair as required. As pressurized air is already a component of the plastic flame spray gun system, the incorporation of the air pressure for purposes of controlling the hopper powder feed valve mechanism from the gun itself is convenient and further does not require additional electrical circuitry, solenoids, or switches. It being recognized of course that the control of hopper valve 60 could be accomplished with other mechanisms such as electrical solenoids, hydraulic mechanical systems or the like, but the convenience, safety and durability of the pneumatic control system is preferred for the reasons as indicated.

In operation, the pressurized air stream carried by nozzle 100 is injected into the second passageway 112 by the nozzle end 104. The high-velocity air stream passing into the second passageway 112 causes a lowering of the air pressure (due to venturi action) in the annular area surrounding the nozzle end 104 which is communicated to the interior of the chamber 110 and to the receiver 24 through valve opening 90. This lowering of the air pressure in the chamber 110 causes high-velocity air flow from the chamber 110 and draws powder 11 through opening 90 and receiver 24 into the second passageway 112. The particulate material is carried into the second passageway by eductor action and is entrained in the stream of pressurized air passing through the bore portion 112 into the gun supply hose 36.

As described above, the adjustment of the spacing between the nozzle end 104 with relation to the junction of the chamber 110 and the bore section 112 regulates the negative pressure (developed by venturi action) in the chamber 110 and determines the flow rate of the particulate material from the hopper assembly into the gun supply line 36. In practice, the nozzle end 104 is adjusted to obtain the highest negative pressure within the chamber 112 and thus the maximum flow rate of particulate material therefrom. While prior eductor mechanisms have been used to educt particulate material from a hopper into a supply line, the above described construction featuring the nozzle end 144 adjustable with respect to the chamber 142 and outlet bore section 44" permits a maximum flow rate of the particulate material entrained in the pressurized stream of supply air without a corresponding increase in the flow rate of the pressurized air passing through bore 116.

Typical thermoplastic particulate materials used in the flame spray process may include NUCREL®, SURLYN®, ELVAX® products commercially available from the DuPont Corporation. However, it is to be specifically noted that the methods and apparatus of the present invention admit to the use of a number of feedstock materials that can be placed into the hopper assembly, and accordingly, the invention is not intended to be so limited to the products herein listed. Substantially any powderized plastic feedstock having a thermoplastic property, such as polyethylene, may be employed with good effect without departing from the spirit and scope of the invention.

The feedstock material will preferably have a particle mesh size between 50–100 mesh. Some typical commercial material feedstocks will have already added thereto a number of additives which will render the feedstock more suitable to the application herein described, such as the aforementioned NUCREL® and SURLYN® materials. However, with respect to other feedstocks, it has sometimes been found desirable to include additives counteracting the adverse effect of light on the plastic such as a UV Stabilizer 531, or an additive such as ERGONOX® 1010 for improving the properties of the feedstock in the presence of heat, both such additives being commercially available from the CIBAGEIGY Company. Additionally, in some applications it has further been found desirable to add talc or a like material to the feedstock material as a "slip" additive to enhance the lubricous or flowing characteristics of the particulate material or even to add some form of elastomer to improve the flexing characteristics of the spray coat applied to the article.

Figure 6:
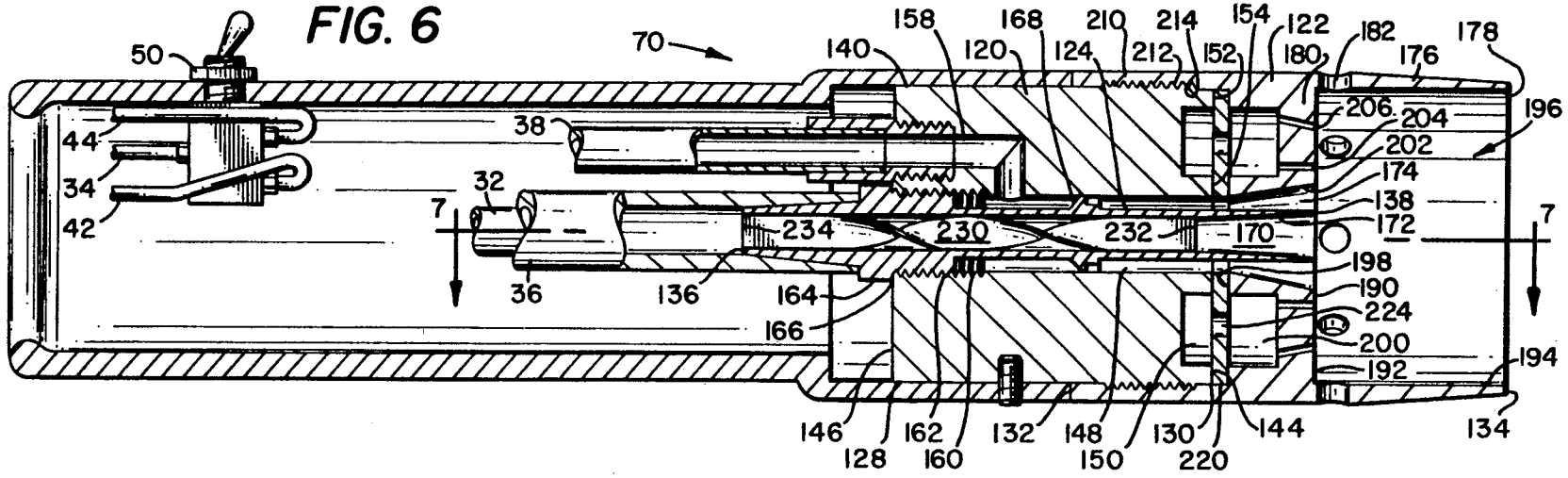
FIG. 6 is a cross-sectional side elevation view of the flame spray gun of the invention.
Figure 7:
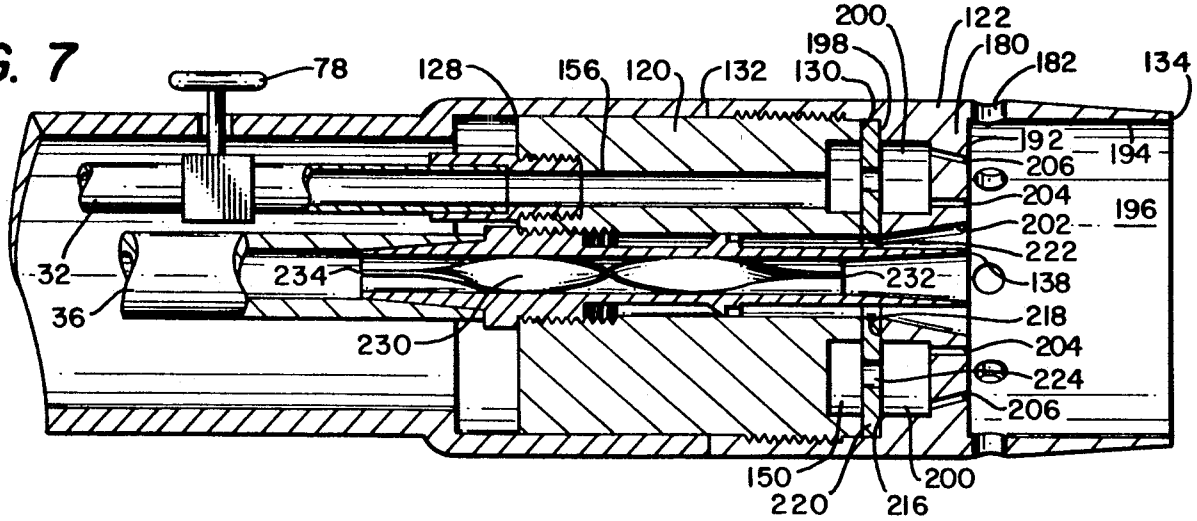
FIG. 7 is a cross-sectional side elevation view of the flame spray gun of FIG. 6, rotated 90 degrees along its longitudinal axis.

Further understanding of the cooperation of the hopper powder control system with the flame spray gun 70 as well as other inventive features can be further understood with reference to FIGS. 6 and 7 in which FIG. 6 is a cross-sectional side elevation view of the flame spray gun of the invention and FIG. 7 is a cross-sectional side elevation view of the flame spraying gun of FIG. 6 rotated 90° along its longitudinal axis. The pneumatic control toggle switch 50 is shown conveniently located on the barrel or handle portion 104 using a fastener means 106.

The gun 70 basically comprises a cylindrical body member 120, a flame hood assembly 122, a material spray nozzle 124 and a flexible diaphragm 220. The body member 120, the material spray nozzle 124 and the flame hood assembly 122 will be described as having a "proximal" end defining the end nearest the air and gas connections, and a "distal" end defining the end most distant from the air and gas connections. Accordingly, the body member 20 has a proximal end 128 and a distal end 130, while the flame hood assembly 122 has a proximal end 132 and a distal end 134. The material spray nozzle has a proximal end 136 and a distal end 138.

The body member 120 includes an elongated cylindrical section 140. The outer surface of section 140 is threaded at 142 for mating with the flame hood assembly as will be hereinafter described. The body member distal end 130 has a planar surface 144 transverse to the centerline of the body member, while the proximal end 128 has a planar surface 146 transverse to the body member centerline. A cylindrical bore 148 is disposed longitudinally through the body member 120 along its central axis and communicates with both the distal and proximal planar end faces. An annular recessed ring 150 is disposed in the body member distal end surface 144 in coaxial relationship to the cylindrical bore 148 for defining a first annular chamber. The planar surface 148 includes an outer annular ring surface 152 and an inner annular ring surface 154 coaxially disposed with respect to bore 148 and radially separated by the coaxial first annular chamber 150.

A first aperture or passageway 156 (shown in figure 7) is disposed through the body member 120 communicating with the body member proximal end face 128 and the first annular chamber 150. A second aperture or passageway 158 (shown in FIG. 6) is disposed in said body member 120 and communicates with the proximal end surface 128 and the cylindrical bore 148 intermediate its length. The bore 148 also has a threaded portion 160 adjacent the body member proximal end 128 for mating with the material spray nozzle 124 as will be further described below.

The material spray nozzle comprises an elongated cylindrical member 124 having an outer diameter less than the diameter of the cylindrical bore 148 and coaxially disposed in the bore. The nozzle 124 has an enlarged externally threaded section 162 that removably mates with the threaded portion 160 of the bore 148 to secure the nozzle 124 therein. The nozzle 124 also has a second enlarged section 164 adjacent the proximal end 136 and intermediate the end 136 and the enlarged externally threaded section 162. The enlarged end section 164 has an annular shoulder 166 facing the threaded section 162 for engaging the proximal end face 146 of the body member when the nozzle tube 124 is threaded into the bore 148.

A radially extending spacer 168 is mounted on the outer wall surface of the tube 124 intermediate the distal end 138 thereof and the threaded section 162. The spacer engages the walls of the nozzle 124 for maintaining the nozzle member in coaxial alignment within the cylindrical bore 148. The nozzle member 124 has a section 170 adjacent the proximal end 138 that includes an inner diameter increasing over the longitudinal length of the section towards the end 138. In cross-section the inner surface 172 of the nozzle section 170 defines a nozzle tip having an outwardly flaring (truncated conical shape) cross-sectional configuration over the length of the nozzle section 170. The annular space 174 between the outer surface of the nozzle cylindrical member 124 and the coaxial bore 148 defines a third passageway disposed in the body member 120 for purposes to be hereinafter explained in greater detail.

The flame hood assembly 122 is a generally cylindrical member having a proximal end 132 and a distal end 134. The flame hood assembly 122 comprises a cylindrical hood section 176 including the open end 178 and a closed end 180. The hood section 176 has thin cylindrical walls and includes a plurality of circumferentially-spaced apertures 182 disposed radially about the circumference of the cylindrical hood section and spaced adjacent the closed end 180. The closed end 180 comprises a circular plate that is disposed internally of and transversely to the axis of the cylindrical hood section 176. The surface of the plate facing the hood section open distal end 178 forms a distal planar surface 192 cooperating with the inner surfaces 194 of the cylindrical hood walls for forming a combustion chamber 196, the function of which will be hereinafter explained in greater detail. The other side of the plate 180 is sized to engagingly mate with the body member distal end face 130 and forms a proximal planar surface 198. The plate proximal plane surface 198 includes an annular recessed ring 200 disposed therein in coaxial alignment with the axis of the hood section for defining a second annular chamber. Chamber 200 is sized to register with the first annular chamber 150 disposed in the distal end face 130 of body member 120.

The plate 180 carries a bore 202 centrally disposed therethrough and in coaxial alignment with the axis of the flame spray hood assembly 122 and is sized to register with the cylindrical bore 148 disposed in the body member distal end 120. The bore 202 in plate 180 receives the projecting nozzle tip end 138 of the material spray nozzle 158, with the bore 202 increasing in diameter from the proximal planar surface side to the distal planar surface side to form a cross-sectional configuration of a truncated cone, the larger end of which faces toward the hood section open distal end 178. preferably the taper of bore 202 is in the range of about 15° to 40° from parallel to the axis.

The plate 180 has a first circular pattern of circumferentially spaced orifices 204 disposed through the plate coaxial with the central bore 202 and communicating between the distal end face 192 of the plate and the interior of the second annular chamber 200. The plate 180 further has a second circular pattern of circumferentially spaced orifices 206 disposed therethrough concentric with the first circular pattern of orifices 204. The second circular pattern of spaced orifices 206 are spaced radially outwardly from the first circular pattern 204, and communicate with the distal end surface 192 and with the interior of the second annular chamber 200. The longitudinal axes of the second plurality of circumferentially spaced orifices 206 preferably angle inwardly toward the central axis of the hood 122 at the distal end thereof. The angle of incline is preferably in a range of about 15° to 30° with respect to the hood section axis for purposes that will be hereinafter described in greater detail.

The proximal end of the flame hood assembly 122 includes a generally cylindrical attachment section 210 that has an inner diameter coincident with the outer diameter of the body member section 140 and as disposed therein an inner threaded surface 212 for threadably mating with the body member threaded surface 214. The proximal end face of plate 180 defines an outer annular ring surface 216 and an inner annular ring surface 218 coaxially disposed with respect to the central bore 148, and are radially separated by the coaxial second annular chamber 200. The diameters of the outer and inner ring surfaces 216 and 218 are identical to the diameters of the outer and inner ring surfaces 152 and 154 of the body section 120 and are sized to register therewith.

A thin circular diaphragm 220 is constructed of a flexible and yieldable material and is disposed between the body member distal end planar surface 144 and the hood member plate proximal planar surface 198. The diaphragm 220 carries a central aperture 222 therethrough, the diameter of which is identical with and registers with the diameters of the cylindrical bore 148 disposed in the body member 120, and the bore 202 opening disposed in the plate 180 proximal planar surface 198 for permitting the spray nozzle tip 138 to project therethrough as hereinabove described. The diaphragm also carries a plurality of circularly-spaced apertures 224 disposed therein in a pattern coaxial with the central aperture 222 and spaced radially from the aperture 222 to communicate with the body member first annular chamber 150 and the hood member plate second annular chamber 200.

As may be seen in FIGS. 6 and 7, the diaphragm 220 is disposed between the body member distal end planar surface 144 and the plate proximal planar surface 198, and sealingly engages the planar surfaces 198 and 144 and between the opposed registering projecting annular plane ring surfaces. With the diaphragm 220 acting as a seal between the body member 120 and the flame hood assembly 122, the first annular chamber 150 and the second annular chamber 200 are sealed together, and separated only by the flexible diaphragm 220 which has communicating apertures 224 therethrough for permitting combustible gas flow therethrough as will be hereinafter further described.

The ring of combustion gas orifices through the hood can be positioned parallel to the central axis of the hood or inclined inwardly up to about 30°. An angular incline of the combustion gas orifices is preferred in an embodiment in which the powder particulate matter entrained in the carrier gas is imparted with a circular motion prior to injection through the hood into the combustion area. A means for imparting rotational moment 230 to the carrier gas such as a bifurcating twisted vein 230 as depicted in FIGS. 6–9, or other gas twirling means is preferably inserted into the injector nozzle adjacent to the distal end of the injector nozzle. It has been found that the twirling means 230 can be advantageously formed as a twisted vein 230 which acts to bifurcate the carrier air and the powder entrained therein into two separate channels of flow. The bifurcated flow is imparted with a swirling motion by the twisted vein. The vein preferably terminates at distal end 232 before the tip 138 of the nozzle to allow the two flow masses to recombine as they are entering into the combustion chamber area. The bifurcation, swirling and recombining action all facilitate and advantageously increase the turbulent mixing and even distribution of plastic powder throughout the combustion or flame area. The twirling action effectively adds lateral components of velocity to the powdered plastic particles entrained in the air flow because of the spiraling action, thus the straight ahead velocity and the centrifugal force includes lateral components some of which are radially outward which tends to "sling" the plastic particles outwardly to both enlarge the diameter of the effective area of the pattern of coated material which can be applied and also to increase the dispersion of particles toward the center of the area. The particles are propelled through the flame to increase the efficiency of the melting.

It has been found that in previous flame guns the flared configuration of the propelling air orifice surrounding the nozzle acted to create a vacuum surrounding the particles being carried through the nozzle and thereby drawing them outwardly in an essentially hollow conical shape. Thus the pattern of melted coating material which was applied was essentially a donut shape having the highest concentration of melted particles in a ring and lower concentrations of melted plastic particles toward the center of the ring and radially outward from the ring. It has now been found, according to the present invention, that, with the use of the twisted vein and the resulting swirling action imparting of centrifugal force to the entrained powder particles, a cloud of more evenly distributed particles results in the combustion area. A solid circle pattern of spray, rather than a hollow circle, is advantageously provided.

It has been found that in conjunction with the increased lateral forces imparted to the plastic particles by the swirling vein, the flame pattern which is governed by the angle of the combustion gas orifices can be advantageously aimed inwardly at angles between 15° and 30° to increase the melting efficiency, as set forth for the preferred embodiment. While the complete mechanism for this is not fully understood, the effective results are that both the spray pattern diameter can be increased and the overall density of the spray pattern can be more evenly distributed over the entire larger diameter area. In this manner according to the invention the amount of particle spray that can be applied is effectively increased. It is currently believed that the radially outward forces applied by the flared propelling air orifice as well as the twirling action of the swirled vein and also the additional turbulence caused by the swirling action results in both a better distribution and increased particle melting efficiency. There appears to be sufficient lateral or radial forces on the particles to propel them outwardly through the burning gas stream thereby widening the overall melted particle spray pattern. Regulation of the propelling air pressure and the flame size and combustion mixture allows the time spent in the flame to be properly adjusted for various materials which may have different melting temperatures.

By aiming the combustion gases inwardly, as with the inward incline of the burning gas orifices, the melting action can be accomplished both at the center of the pattern and also at the outer edges. All of the particles which are propelled radially through the flame and otherwise exposed to the heat of the flame are melted to create a pattern which can have effectively 50% larger diameter than previous donut pattern diameters without adversely affecting the complete melting of the thermoplastic resin.

Figure 9:
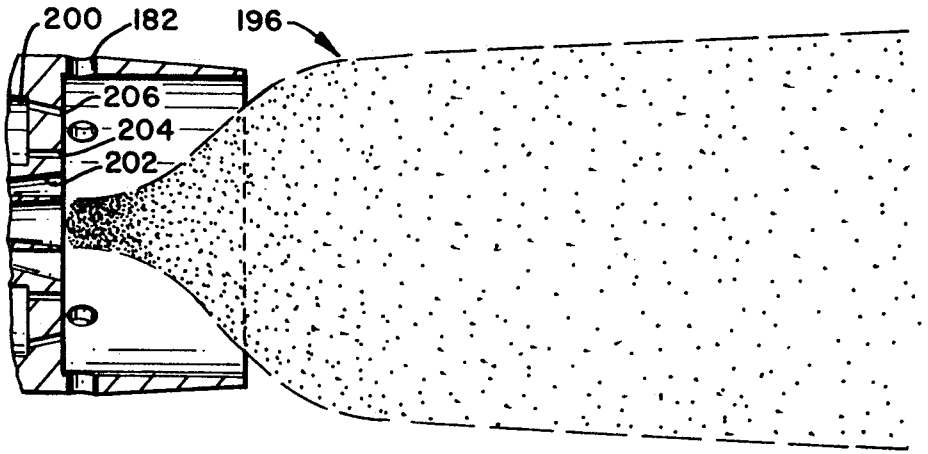
FIG. 9 is a simplified cross-sectional side elevation view, partially broken away, of the hood end of the flame spray gun of the invention showing diagrammatically the dispersion of the melted powder being discharged from the gun.

This phenomenon may be better understood with reference to FIG. 9 in which the particle cloud is schematically depicted. Preferably the cloud and the spray pattern can be maintained in the range of diameters from about greater than or equal to the diameter of the spray nozzle to less than or equal to one and one-half times the diameter of the spray nozzle.

Figure 8:
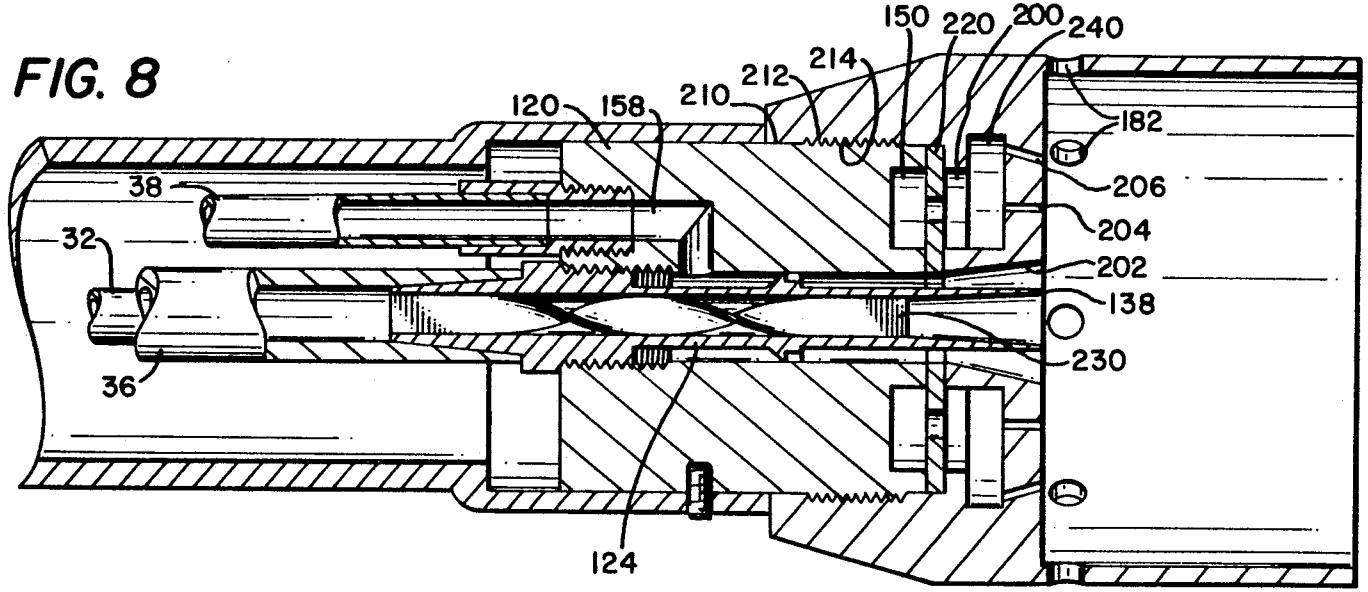
FIG. 8 is a cross-sectional side elevation view of a flame spray gun as depicted in FIG. 6, but having a larger diameter flame hood assembly releasably engaged to the body of the gun.

It has also been found to be advantageous with reference to FIG. 8 to have interchangeable hoods of varying sizes which can be attached to the same gun body to increase the flame and particle application pattern without requiring reattachment of an entirely separate spray gun. This can be accomplished by maintaining the same size of all mating surfaces, annular chambers, and threads for all hoods. The combustion chamber will be enlarged and the diameter of the concentric rings of combustion orifices 206 and 204 will be larger. To accommodate this size increase an enlarged portion 240 of annular ring 200 is formed. The time and effort and reduction of possibility of damage to the gun assembly results from avoiding detachment and reattachment of the various hoses and hose fittings to separate guns. An operator need not go to the expense of having two or more complete separate spray guns. A significant reduction of costs and other advantages are achieved over prior guns which required different bodies to increase the hood size. The combustion gas flow rate, the propelling air flow rate and the amount of powder to be distributed can be adequately adjusted with the regulation of the pressure through the eductor as well as appropriate adjustment to the combustion gas and air flame mixture pressures.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

I claim:

1. A flame spray coating system for melting and propelling powdered material onto a substrate comprising:

(a) a powder supply hopper;

(b) an eductor adapted to entrain the powder material in a flow of conveying air;

(c) a valve disposed between the powder hopper and eductor for controlling a flow of the powder material from the hopper into the eductor;

(d) a flame spray gun;

(e) means for delivering flows of propelling air, the conveying air, the powder material entrained in the conveying air, and a combustible gas to the flame spray gun; and (f) a control means disposed on the flame spray gun for controlling operation of the valve disposed between the powder hopper and eductor independently of the flow of conveying air.

2. A flame spray coating system as in claim 1 wherein the valve disposed between the hopper and the educator is a rotary barrel valve.

3. A flame spray coating system as in claim 2 wherein the control means is a pneumatic switch which selectably actuates the rotary barrel valve between an open and a closed position.

4. A flame spray coating system as in claim 3 further comprising:

(a) a pinion coaxially attached to the barrel valve for rotation therewith;

(b) a rack engaging the pinion gear and having first and second pressurizable chambers on either side for causing linear motion upon pressurizing one or the other chamber so that the pinion is rotated upon linear actuation of the rack;

(c) a regulated air pressure communication with the input of the pneumatic switch; and (d) first and second output conduits communicating from the switch to the first and second pressurizable chambers so that selectively toggling the switch causes regulated air pressure to pressurize the first or the second chamber to thereby move the rack, rotate the pinion and change the position of the barrel valve between the open and closed position as desired.

5. A flame spray coating system as in claim 1 further comprising:

(a) a combustion chamber hood attached to the flame gun for burning mixture of gas and air in a flame for melting the entrained powder materials; and (b) a combustible gas control disposed on the flame spray gun for controlling the combustible gas to be ignited and burned in the combustion chamber hood.

6. A flame spray coating system as in claim 5 further comprising means for swirling the entrained powder material and air mixture and for discharging it into the flame at the combustion chamber hood.

7. A flame spray coating system as in claim 6 further comprising a gun body adapted for alternate engagement with hood sections of differing flame diameters to achieve various flame spray coverage areas with the same gun body.

8. A feed assembly for use in a flame spray coating system comprising:

(a) a powder source;

(b) a pressurized gas source;

(c) a pressure regulator for regulating a flow of gas from the pressurized gas source;

(d) an eductor assembly for introducing powder into the flow of gas from the pressurized gas source; and (e) remotely controlled means for selectively controlling the introduction of powder into the flow of gas from the pressurized as source independently of the flow of gas from the pressurized gas source.

9. A powder flame spray gun comprising:

(a) means for connecting the gun to a flow of pressurized conveying gas; and (b) means disposed on the gun for selectively controlling the introduction of a thermoplastic powder into the flow of pressurized conveying gas at a point remote from the gun independently of the flow of pressurized conveying gas.

10. The powder flame spray gun of claim 9 comprising releasably engageable body and hood sections, the body section comprising the means for connecting the gun to the flow of pressurized conveying gas and wherein said releasably engageable body section comprises means for selectively attaching hood sections of differing diameters to achieve different coverage areas and coverage rates for spray coating.

11. A method for flame spraying a thermoplastic coating onto a substrate comprising the steps of:

(a) providing a source of powder having a major portion of a thermoplastic resin;

(b) providing a flame spray gun;

(c) providing a flow of pressurized gas to convey the powder from the powder source to the flame spray gun;

(d) controlling from the flame spray gun the introduction of powder into the flow of pressurized conveying gas at a point remote from the flame spray gun independently of the flow of pressurized conveying gas;

(e) propelling air and combustible gas from the flame spray gun;

(f) combusting the combustible gas to melt the powder as it is discharged from the flame spray gun; and (g) applying the melted powder to a substrate.

12. A method as in claim 11 wherein the step of applying the melted powder to the substrate includes the step of forming a filled circular pattern of the melted powder which is applied to the substrate.

* * * * *